US008764007B2

(12) United States Patent
Saito

(10) Patent No.: US 8,764,007 B2
(45) Date of Patent: Jul. 1, 2014

(54) SHEET CONVEYING DEVICE HAVING FUNCTION OF CORRECTING SKEW OF SHEET

(75) Inventor: Hiroshi Saito, Kashiwa (JP)

(73) Assignee: Canon Kabushiki Kaisha (JP)

( * ) Notice: Subject to any disclaimer, the term of this patent is extended or adjusted under 35 U.S.C. 154(b) by 0 days.

(21) Appl. No.: 13/307,234

(22) Filed: Nov. 30, 2011

(65) Prior Publication Data

US 2012/0133093 A1 May 31, 2012

(30) Foreign Application Priority Data

Nov. 30, 2010 (JP) ..... 2010-266973

(51) Int. Cl.
*B65H 7/02* (2006.01)
*B65H 9/00* (2006.01)
*B65H 33/04* (2006.01)

(52) U.S. Cl.
CPC ..... *B65H 9/002* (2013.01); *B65H 2301/331* (2013.01); *B65H 33/04* (2013.01)
USPC ..... 271/228; 271/227; 271/226; 270/58.32

(58) Field of Classification Search
CPC ... B65H 2301/331; B65H 9/002; B65H 33/04
USPC ..... 271/226, 227, 228, 246; 399/395; 270/58.32
See application file for complete search history.

(56) References Cited

U.S. PATENT DOCUMENTS

| | | | | |
|---|---|---|---|---|
| RE37,007 | E * | 1/2001 | Gerlier | 250/548 |
| 2006/0208416 | A1* | 9/2006 | Dejong et al. | 271/228 |
| 2007/0257423 | A1* | 11/2007 | Mandel | 271/227 |
| 2011/0200341 | A1* | 8/2011 | Moriya | 399/16 |
| 2012/0025457 | A1* | 2/2012 | Inoue | 271/227 |

FOREIGN PATENT DOCUMENTS

| | | | |
|---|---|---|---|
| JP | 04-277151 | A | 10/1992 |
| JP | 2003-146485 | A | 5/2003 |

* cited by examiner

*Primary Examiner* — Patrick Cicchino
(74) *Attorney, Agent, or Firm* — Rossi, Kimms & McDowell LLP

(57) ABSTRACT

A sheet conveying device that makes it possible to perform printing at high speed with high accuracy by easily correcting skew of a sheet, such as an index tab sheet, without requiring troublesome operations. Sheet detection sensors for detecting a sheet and skew correction rollers for conveying the sheet are disposed in a direction crosswise to a conveying direction of the sheet. A skew correction drive controller measures a leading edge detection time between respective detections of a leading edge of the sheet by the sensors, and controls the conveying speeds of the skew correction rollers independently of each other such that a skew represented by the leading edge detection time is corrected. If the leading edge detection time is not smaller than a predetermined threshold value, the skew correction drive controller reduces a skew correction amount for correcting the skew by a predetermined amount.

8 Claims, 16 Drawing Sheets

SHEET CONVEYING DEVICE HAVING FUNCTION OF CORRECTING SKEW OF SHEET

BACKGROUND OF THE INVENTION

1. Field of the Invention

The present invention relates to detection of skew of a sheet in a sheet conveying device equipped in an image forming apparatus, such as a copying machine or a printer, or in an image reading apparatus, such as a scanner.

2. Description of the Related Art

In general, in an image forming apparatus, such as a copying machine or a printer, during printing, a sheet is conveyed to an image forming section, and printing is performed on the conveyed sheet. In this sheet conveyance, a sheet is sometimes conveyed obliquely with respect to a conveying direction, i.e. so-called skew sometimes occurs. If skew of a sheet occurs, when the image forming section transfers a toner image onto the sheet, the position of the image is displaced with respect to the sheet. As a result, occurrence of skew of a sheet sometimes prevents the printing operation from being performed with high accuracy. To overcome this problem, conventional sheet conveying devices are each equipped with a skew correction mechanism for correcting skew of a sheet.

On the other hand, to perform printing at high speed, it is necessary to promptly perform correction of skew of a sheet. To this end, there has been proposed a skew correction mechanism using a so-called active registration method, as a skew correction mechanism. In this active registration method, skew caused when a sheet is fed is corrected while conveying the sheet (see e.g. Japanese Patent Laid-Open Publication No. H04-277151). This mechanism increases the speed of printing by promptly performing correction of skew of a sheet.

By the way, in an image forming apparatus, image formation on various types of sheets is desired. For example, it is desired that image formation (printing) can be also performed on a sheet which is not always a rectangle, such as an index tab sheet (also referred to as the tab sheet). Note that the index tab sheet is intended to mean a sheet on which an index tab is formed on a sheet edge, for entry of headings or the like for the purpose of classification. Further, there has been proposed a skew correction method for sheets not having a rectangular shape, such as index tab sheets.

FIG. 10 illustrates an example of a conventional skew correction mechanism. In the illustrated skew correction mechanism, two skew-detection sensors 82 and 83 are disposed along a direction orthogonal to a direction of conveying a sheet 81. The skew correction mechanism further includes a pair of conveying rollers 84 and 85 the respective conveying speeds of which are variable.

In the illustrated example, the sheet 81 is an index tab sheet, and sheet shape information indicative of a dimension X (dimension in the conveying direction) of an index tab 81*a* is registered in a memory or the like in advance. Further, a position of the index tab 81*a* on the index tab sheet is registered in the memory or the like in advance as position information.

In this mechanism, the skew detection sensors 82 and 83 each detect an edge of the index tab sheet 81 to obtain an amount of skew of the index tab sheet 81 according to the detection result X', the above-mentioned dimension X (sheet shape information), and the position information. Then, the conveying speeds of the conveying rollers 84 and 85 are controlled, respectively, according to the amount of skew, to thereby correct the skew of the index tab sheet.

On the other hand, there has been proposed a technique in which to detect skew of a sheet, line sensors are provided in a sheet width direction and a shape of an edge of the sheet is detected by the line sensors (see e.g. Japanese Patent Laid-Open Publication No. 2003-146485). In Japanese Patent Laid-Open Publication No. 2003-146485, the shape of the edge of the sheet detected by the line sensors is subjected to image processing to thereby calculate an amount of skew of the sheet, whereby correction of skew of the sheet is performed.

Incidentally, when a plurality of index tab sheets are compared with each other, index tabs are not formed on the same position on the respective index tab sheets. More specifically, the index tabs are formed in a manner displaced on an index tab sheet-by-index tab sheet basis such that headings or the like written in the respective index tabs are easily confirmed when the plurality of index tab sheets are arranged one upon another.

When correcting skew of each index tab sheet formed as above, it is necessary to know whether or not an index tab passes a skew detection sensor in advance. For this reason, the user is required to designate whether or not a sheet is an index tab sheet, and further set the position of each index tab, the dimension of the same, and so forth, in a detailed manner, in the image forming apparatus.

Therefore, there is a problem that the user is required to perform troublesome operations when he/she intends to perform the skew correction for index tab sheets in order to perform printing with high accuracy at high speed.

The above-mentioned problem is also caused when original documents, which are index tab sheets, are consecutively read. More specifically, when the original documents are set on a document tray of an image reading apparatus so as to be read by the apparatus, the documents are conveyed from the document tray to a document reading position, but if it is intended to perform the skew correction at this time, the user is required to perform the troublesome operations described above.

SUMMARY OF THE INVENTION

The present invention provides a sheet conveying device that makes it possible to perform printing at high speed with high accuracy by easily correcting skew of a sheet, such as an index tab sheet, without requiring troublesome operations.

The present invention provides a sheet conveying device comprising first and second detection sensors that are disposed in a direction crosswise to a conveying direction for conveying a sheet, for detecting the sheet, first and second conveying units that are disposed in a direction crosswise to the conveying direction, for conveying the sheet, a timer configured to measure a leading edge detection time from when one of the first and second detection sensors detects a leading edge of the sheet to when the other of the first and second detection sensors detects the leading edge of the sheet, and a skew correction unit configured to control respective conveying speeds of the first and second conveying units independently of each other such that a skew corresponding to the leading edge detection time is corrected, wherein when the time measured by the timer is not smaller than a predetermined threshold value, the skew correction unit reduces a skew correction amount for correcting the skew corresponding to the leading edge detection time by a predetermined amount.

According to the present invention, it is possible to obtain an advantageous effect that a sheet, such as an index tab sheet, can be printed at high speed with high accuracy by easily correcting skew of the sheet without requiring troublesome operations.

Further features of the present invention will become apparent from the following description of exemplary embodiments with reference to the attached drawings.

BRIEF DESCRIPTION OF THE DRAWINGS

FIGS. 3A and 3B are diagrams useful in explaining the operation of the skew correction unit shown in FIG. 2, in which FIG. 3A shows a skewed state of a sheet, and FIG. 3B shows conveying speeds of skew correction rollers.

FIGS. 4A to 4C are views of examples of a configuration screen displayed on an operation and display section appearing in FIG. 1, in which FIG. 4A illustrates a screen displaying a sheet list, FIG. 4B illustrates a details/edit screen for sheet configuration, and FIG. 4C illustrates a selection screen displayed when a change button for an item "feature" is selected from the details/edit screen shown in FIG. 4B, for a user to select and set a feature of the sheet.

FIGS. 5A to 5E are views of examples of a configuration screen displayed on the operation and display section appearing in FIG. 1, in which FIG. 5A illustrates a display screen showing a type and size of a sheet registered in a sheet information-storing section on a paragraph-by-paragraph basis, and a status of use, from which a sheet size can be selected and registered, FIG. 5B illustrates a print configuration screen for configuring print settings including sheet selection, before printing, FIG. 5C illustrates a screen for selecting a sheet for use in printing, FIG. 5D illustrates a screen for setting a print shift width for an index tab sheet in the case of index tab sheet printing, and FIG. 5E illustrates a protruding dimension (print shift amount) of an index tab.

FIGS. 7A to 7F are views useful in explaining detection of skew of an index tab sheet performed by the skew correction unit appearing in FIG. 1, in which FIG. 7A illustrates conveying of an index tab sheet with an index tab at a location not close to an end of the index tab sheet, FIG. 7B illustrates timing in which a leading edge of the index tab sheet shown in FIG. 7A is detected, FIG. 7C illustrates conveying of an index tab sheet with an index tab at a location close to the end of the index tab sheet, FIG. 7D illustrates timing in which a leading edge of the index tab sheet shown in FIG. 7C is detected, FIG. 7E illustrates a state of the index tab sheet shown in FIG. 7C further conveyed from the state shown in FIG. 7C, and FIG. 7F illustrates timing in which a trailing edge of the index tab sheet shown in FIG. 7E is detected.

DESCRIPTION OF THE EMBODIMENTS

The present invention will now be described in detail below with reference to the accompanying drawings showing embodiments thereof.

Figure 1:
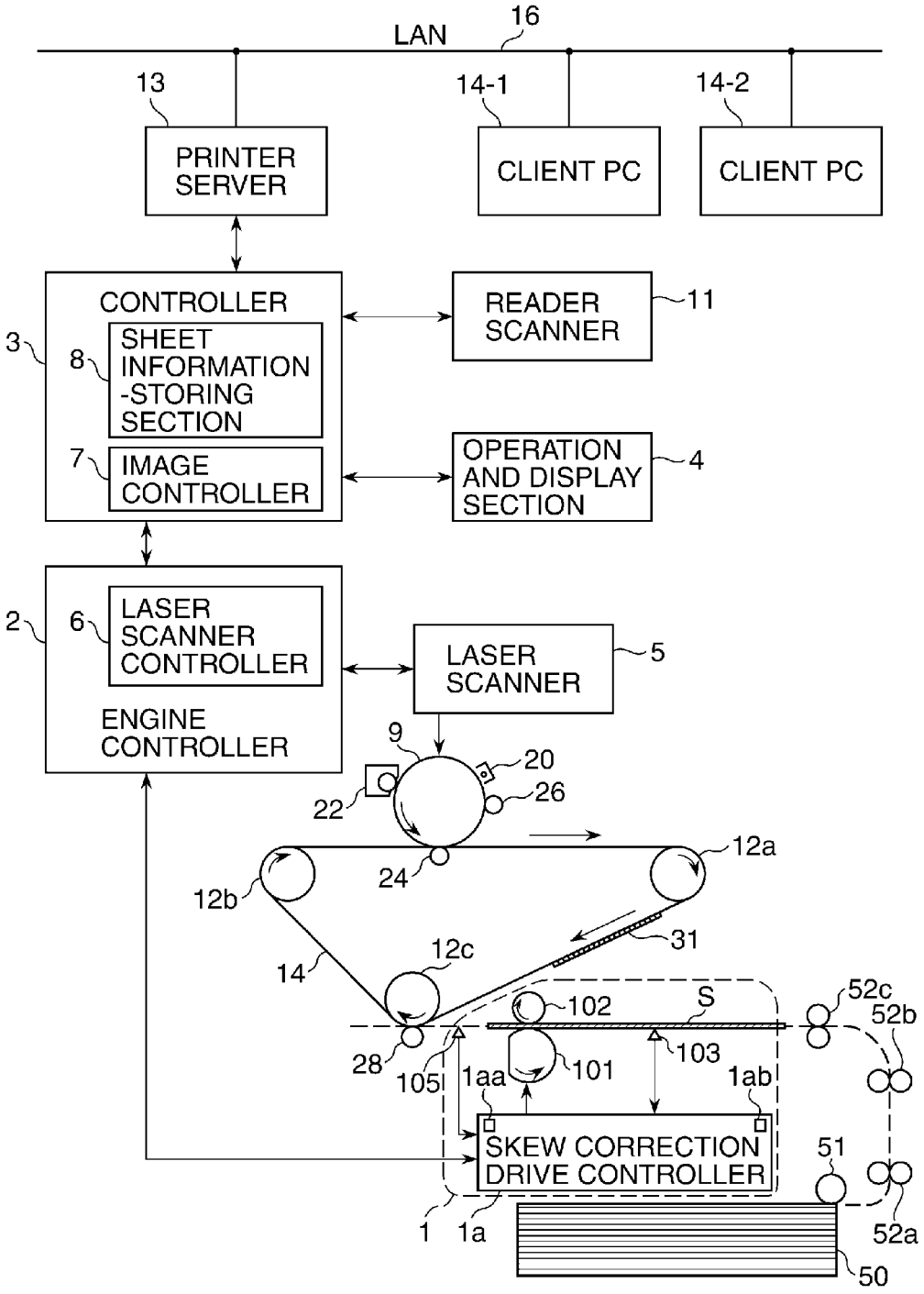
FIG. 1 is a view showing essential parts of an image forming apparatus using a sheet conveying device according to an embodiment of the present invention.

FIG. 1 is a view showing essential parts of an image forming apparatus using a sheet conveying device according to an embodiment of the present invention, and a network to which the image forming apparatus is connected.

The image forming apparatus shown in FIG. 1 includes a engine controller 2, and a controller 3. In the illustrated example, a reader scanner 11 and an operation and display section 4 are connected to the controller 3. The controller 3 controls the operation and display section 4 to display various kinds of information, and receives operation commands and the like from the operation and display section 4.

An image on an original scanned by the reader scanner 11 is sent to the controller 3 as image data. The controller 3 includes an image controller 7 and a sheet information-storing section 8, and the sheet information-storing section 8 stores sheet information associated with sheets, described hereinafter. The image controller 7 controls the engine controller 2 according to the above-mentioned image data.

The engine controller 2 includes a laser scanner controller 6, which drivingly controls a laser scanner 5 according to the image data to cause laser exposure of a photosensitive drum 9, as described hereinafter.

In the illustrated example, the controller 3 is connected to a printer server 13. The printer server 13 is connected to a plurality of client PCs 14-1 and 14-2 via a LAN (local area network) 16.

This enables each of the client PCs 14-1 and 14-2 to send image data to the printer server 13 and print the same. More specifically, the controller 3 receives the image data from the printer server 13, and controls the engine controller 2 according to the received image data.

As shown in FIG. 1, an electrostatic charger 20, a developing device 22, a primary transfer roller 24, and a cleaning roller 26 are disposed around the photosensitive drum 9. A surface of the photosensitive drum 9 is uniformly charged by the electrostatic charger 20. Then, as mentioned above, the laser scanner controller 6 drivingly controls the laser scanner 5 according to the image data to form an electrostatic latent image on the photosensitive drum 9.

The electrostatic latent image on the photosensitive drum 9 is developed by the developing device 22 into a toner image. Then, the toner image is transferred onto an intermediate transfer belt 14 by the primary transfer roller 24. The toner remaining on the photosensitive drum 9 is removed by the cleaning roller 26.

Noted that although in the illustrated example, only one photosensitive drum 9 is illustrated, actually, four photosensitive drums are provided, and these photosensitive drums are associated with a yellow (Y) toner, a cyan (C) toner, a magenta (M) toner, and a black (BK) toner, respectively. The toner images on the respective photosensitive drums are sequentially transferred onto the intermediate transfer belt 14 in a superposed manner as a color toner image 31.

The illustrated intermediate transfer belt 14 is suspended by a drive roller 12*a*, a driven roller 12*b*, and a tension roller 12*c*, and is driven for rotation in a direction indicated by a solid arrow in FIG. 1. A secondary transfer roller 28 (transfer unit) is disposed at a location opposed to the tension roller 12*c*, and the nip of the tension roller 12*c* and the secondary transfer roller 28 define a secondary transfer position (image transfer position).

A sheet S is picked up from a sheet feed cassette 50 (sheet accommodating cassette) by a pickup roller 51, and is conveyed to the above-mentioned secondary transfer position by the sheet conveying device. The sheet conveying device includes conveying roller pairs 52*a*, 52*b*, and 52*c*, and includes a skew correction unit 1 disposed at a location downstream of the conveying roller pair 52*c*.

The skew correction unit 1 corrects skew of the sheet S conveyed along a conveying path, and sends the sheet S to the secondary transfer position. At this time, the skew correction unit 1 adjusts the speed of conveying the sheet S in order to synchronize the toner image (color toner image) 31 on the intermediate transfer belt 14 and the sheet S. Then, the toner image 31 on the intermediate transfer belt 14 is transferred onto the sheet S at the secondary transfer position (secondary transfer). Thereafter, the sheet S is conveyed to a heat fixing section (not shown), where the toner image on the sheet S is heated and fixed. Then, the sheet S is discharged to a discharge tray (not shown).

Note that as mentioned above, the engine controller 2 controls not only image formation but also sheet conveyance.

Figure 2:
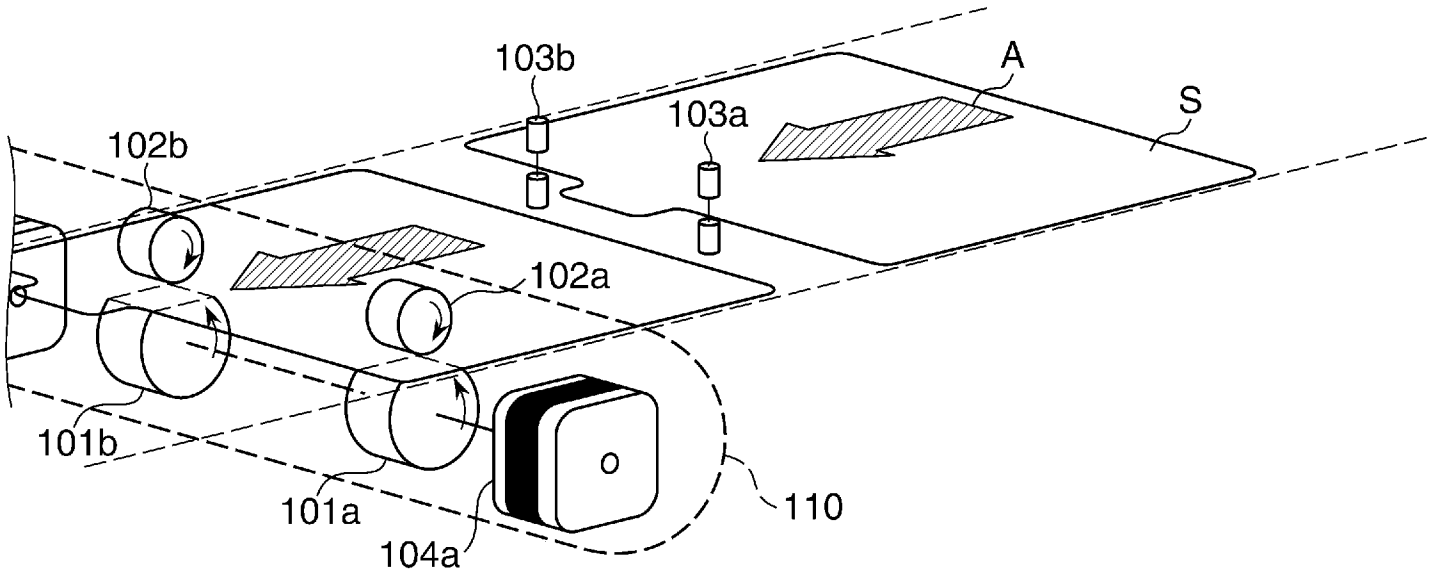
FIG. 2 is a perspective view useful in explaining the arrangement of a skew correction unit appearing in FIG. 1.

FIG. 2 is a perspective view useful in explaining the arrangement of the skew correction unit 1 appearing in FIG. 1.

The sheet S is conveyed in a direction indicated by an arrow A shown in FIG. 2. The skew correction unit 1 includes a skew correction drive controller 1*a* (see FIG. 1) and two sheet detection sensors (first and second detection sensors) 103*a* and 103*b*. These sheet detection sensors 103*a* and 103*b* are disposed such that they are spaced from each other in a direction crosswise to the arrow A (e.g. a direction orthogonal to the arrow A) by a predetermined space.

In the illustrated example, the sheet detection sensors 103*a* and 103*b* are each implemented by an optical sensor and each include a light emitter and a light receiver. The light emitter and the light receiver are opposed to each other across a flat surface (conveying surface) on which the sheet S is conveyed. With this arrangement, when the sheet S passes positions at which the sheet detection sensors 103*a* and 103*b* are disposed, lights output from the respective light emitters are blocked by the sheet S. That is, the lights output from the light emitters are prevented from being received by the light receivers.

Therefore, when a leading edge of the sheet S passes the sheet detection sensors 103*a* and 103*b*, the light receivers of the sheet detection sensors 103*a* and 103*b* do not receive lights output from the respective light emitters of the same. This causes the sheet detection sensors 103*a* and 103*b* to detect the leading edge of the sheet S. Thereafter, the sheet S is conveyed to a skew correction-operating section 110.

The skew correction-operating section 110 includes stepping motors 104*a* and 104*b*. On the conveying path, skew correction rollers (conveying unit) 101*a* and 101*b* (generically denoted by 101 in FIG. 1) are disposed such that they are spaced from each other in a direction crosswise to the direction of conveying the sheet S (e.g. direction orthogonal to the sheet conveying direction) by a predetermined space. The above-mentioned sheet detection sensors 103*a* and 103*b* (generically denoted by 103 in FIG. 1) are disposed at locations upstream of the skew correction rollers 101*a* and 101*b* in the sheet conveying direction.

The stepping motors 104*a* and 104*b* drive the skew correction rollers 101*a* and 101*b*, respectively. Driven rollers 102*a* and 102*b* (generically denoted by 102 in FIG. 1) are disposed at respective locations opposed to the skew correction rollers 101*a* and 101*b* across the flat surface (conveying surface) on which the sheet S is conveyed.

Further, a sheet detection sensor 105 is disposed at a location downstream of the skew correction roller 101*b*. This sheet detection sensor 105 has the same arrangement as those of the sheet detection sensors 103*a* and 103*b*, and a light emitter and a light receiver of the sheet detection sensor 105 are opposed to each other across the flat surface (conveying surface) on which the sheet S is conveyed.

The skew correction drive controller 1*a* appearing in FIG. 1 drivingly controls the stepping motors 104*a* and 104*b* according to a detection result from the sheet detection sensors 103*a* and 103*b* and a control signal sent from the engine controller 2, as described hereinafter. This causes the skew correction rollers 101*a* and 101*b*, and the driven rollers 102*a* and 102*b* to turn the sheet S on the conveying surface, while conveying the sheet S, to thereby correct skew of the sheet S.

Figure 3A:
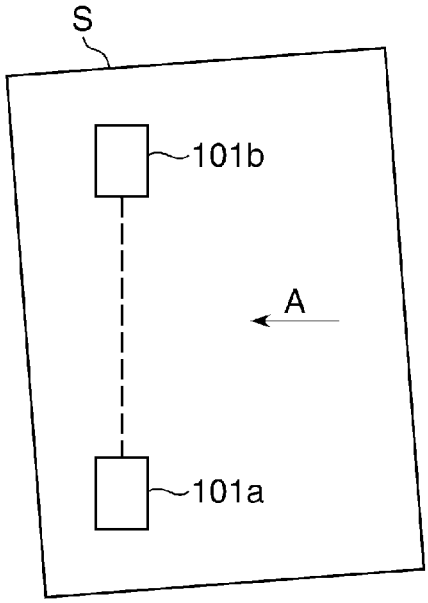
Figure 3B:
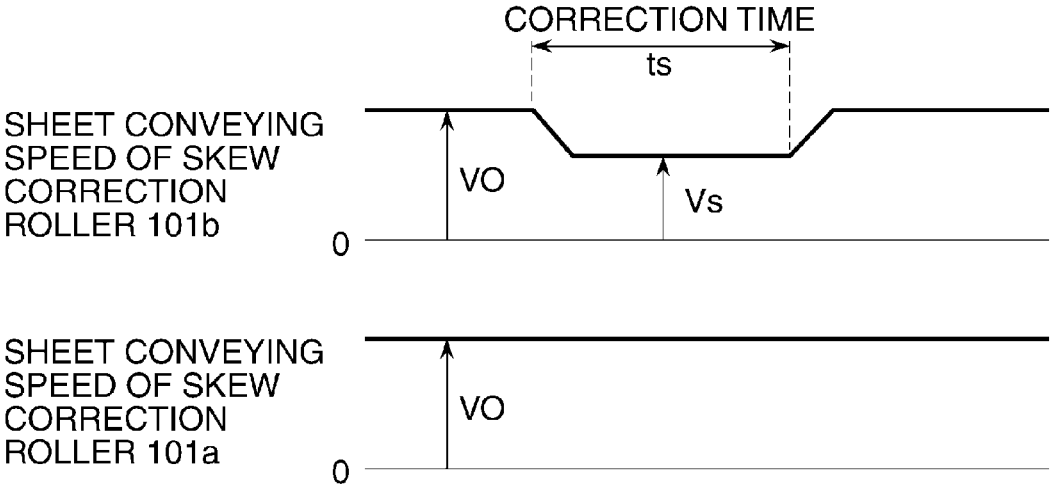

FIGS. 3A and 3B are diagrams useful in explaining the operation of the skew correction unit 1 shown in FIG. 2, in which FIG. 3A illustrates a skewed state of the sheet, and FIG. 3B illustrates conveying speeds of the skew correction rollers 101*a* and 101*b*.

Now, let it be assumed, as shown in FIG. 3A, that the sheet S being conveyed in the conveying direction A has a side thereof toward the skew correction roller 101*b* advanced. In this case, the sheet detection sensor 103*b* (second detection sensor) appearing in FIG. 2 first detects the leading edge (leading side) of the sheet S, and then the sheet detection sensor 103*a* (first detection sensor) detects the leading edge of the sheet S. As described hereinafter, an amount of skew of the sheet S is calculated according to the difference between the respective times of detection of the sheet S by the sheet detection sensors 103*a* and 103*b*.

Therefore, as shown in FIG. 3B, the skew correction drive controller 1*a* holds the conveying speed of the skew correction roller 101*a* at a fixed conveying speed V0, and sets the conveying speed of the skew correction roller 101*b* to a conveying speed Vs which is slower than the conveying speed V0 for a correction time is dependent on the skew amount. Then, the skew correction drive controller 1*a* causes the sheet S to be turned by the difference between the conveying speeds of the skew correction rollers 101*a* and 101*b* to thereby correct the skew of the sheet S.

Figure 4A:
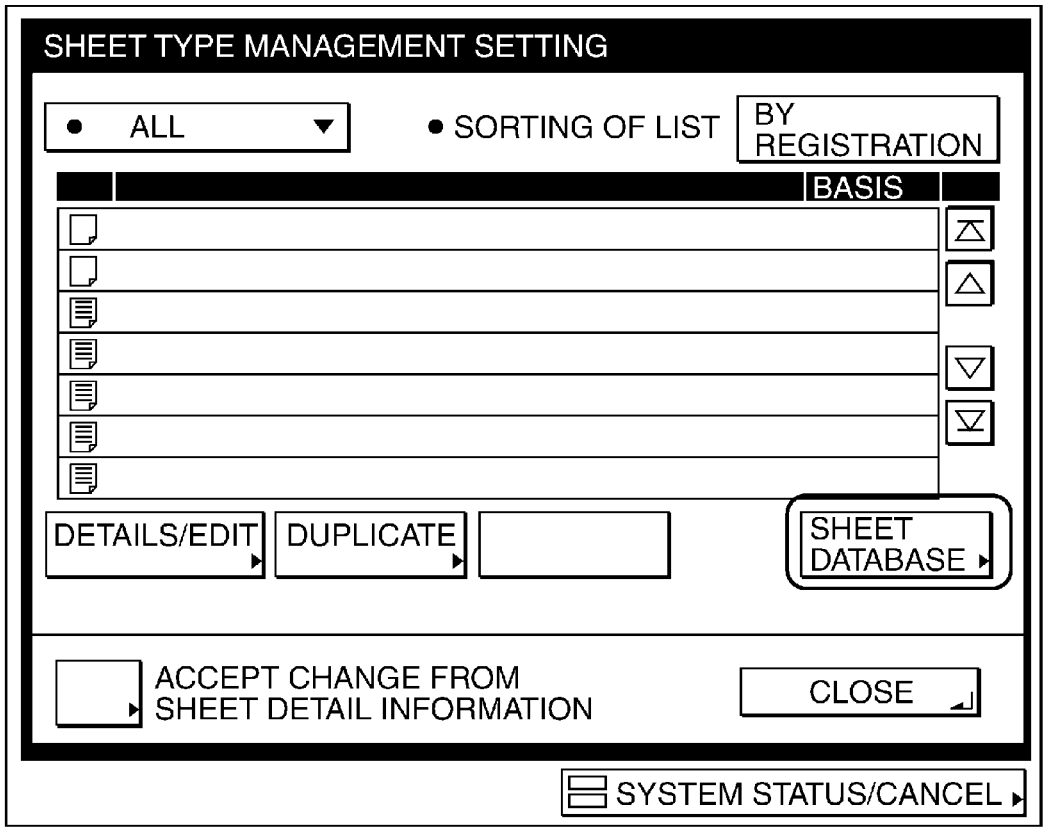
Figure 4B:
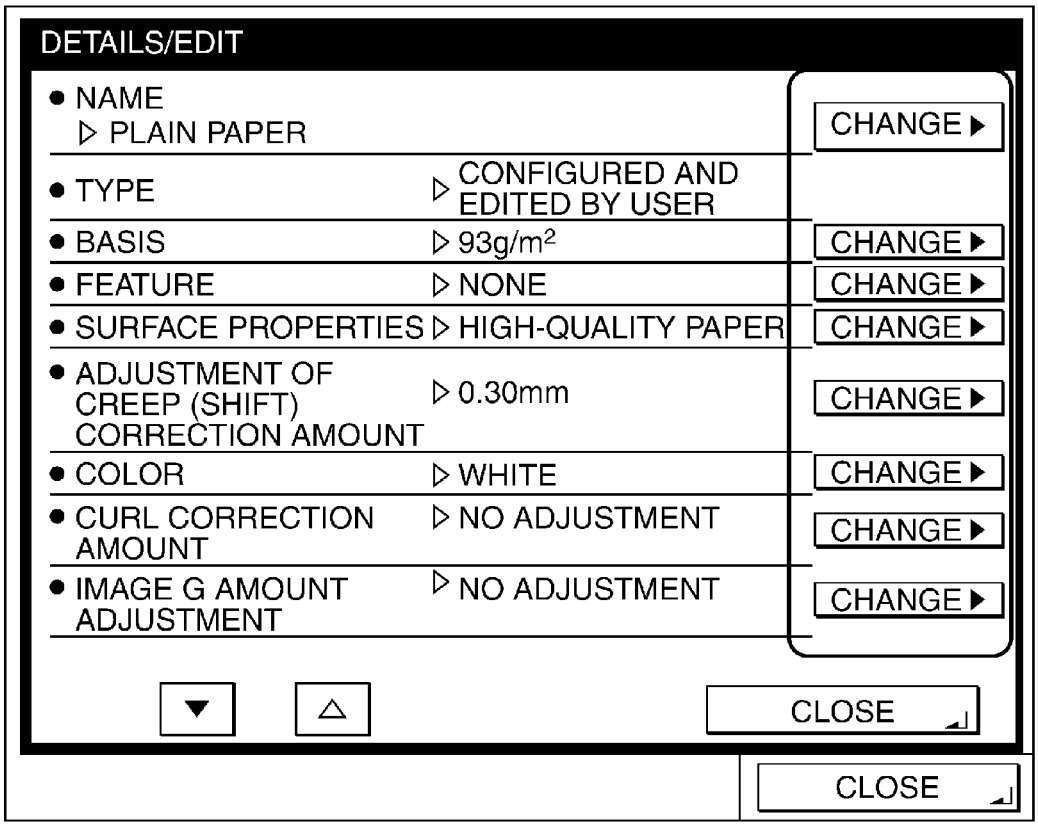
Figure 4C:
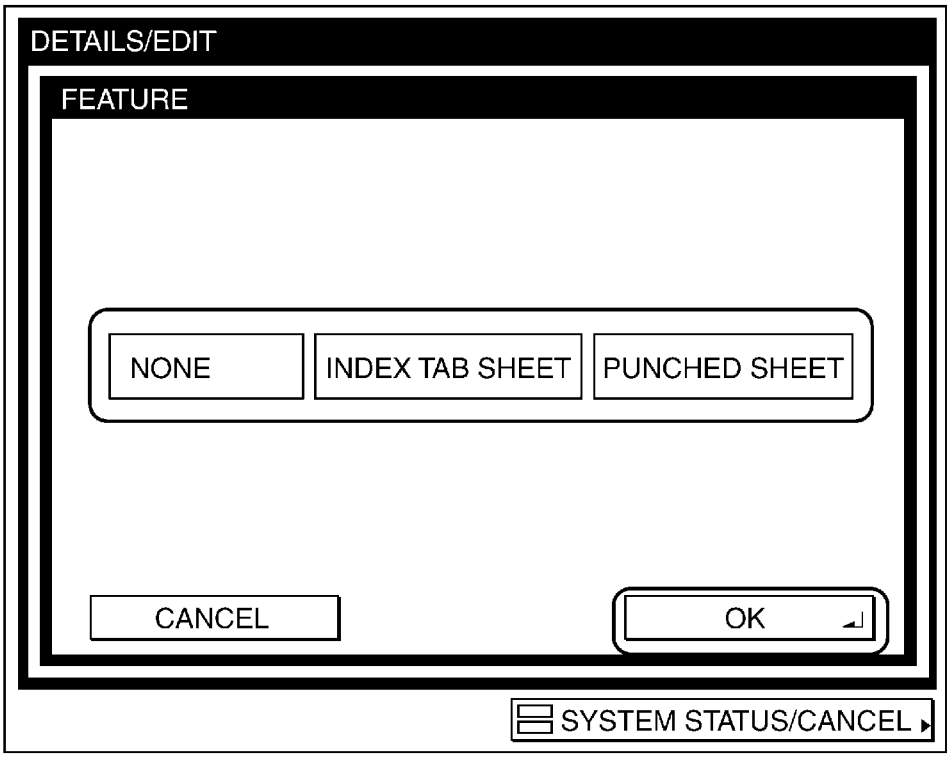

FIGS. 4A to 4C are views of a configuration screen displayed on the operation and display section 4 appearing in FIG. 1. FIG. 4A illustrates a screen displaying a sheet list. FIG. 4B illustrates a details/edit screen for sheet configuration. Further, FIG. 4C illustrates a selection screen displayed when a change button for an item "feature" is selected from the details/edit screen shown in FIG. 4B, for a user to select and set a feature of the sheet.

In the sheet information-storing section 8 appearing in FIG. 1, sheet information associated with a sheet is registered as a sheet list. This sheet list is information associated with all of sheets for use in the image forming apparatus, and is also referred to as the database.

Now, assuming that the user operates a database button (not shown) displayed on the operation and display section 4, the controller 3 reads the sheet list from the sheet information-storing section 8, and displays the read sheet list on the screen of the operation and display section 4 (see FIG. 4A). Note that in FIG. 4A, details of the sheet list is omitted from illustration.

The screen in FIG. 4A displays the sheet list showing conditions and a basis weight of each registered sheet. Further, this screen also displays a details/edit button, a duplicate button, a sheet database button, and so forth. In the sheet list, sheet information generally used in the image forming apparatus has been registered in advance. Note that the user can customize a sheet type (paper type) which has not been registered in the sheet list.

Here, the sheet information indicates details of configuration of a sheet (settings of sheet characteristics) concerning a name, a basis weight, surface properties, a color, a correction value for correcting an amount of misalignment, a correction value for correcting an amount of curl, a shape, and etc. of the sheet. On the screen shown in FIG. 4A, when the user selects a desired sheet from the sheet list and operates the details/edit button, the controller 3 displays the details/edit screen shown in FIG. 4B on the operation and display section 4. In the example shown in FIG. 4B, the details/edit screen associates with plain paper is displayed.

On the other hand, by selecting the change button associated with the item "feature" displayed on the details/edit screen, the user can set a normal rectangular sheet (e.g. plain paper), an index tab sheet, a sheet with punched holes, or the like (see FIG. 4C), for the feature (shape) of the sheet.

Figure 5A:
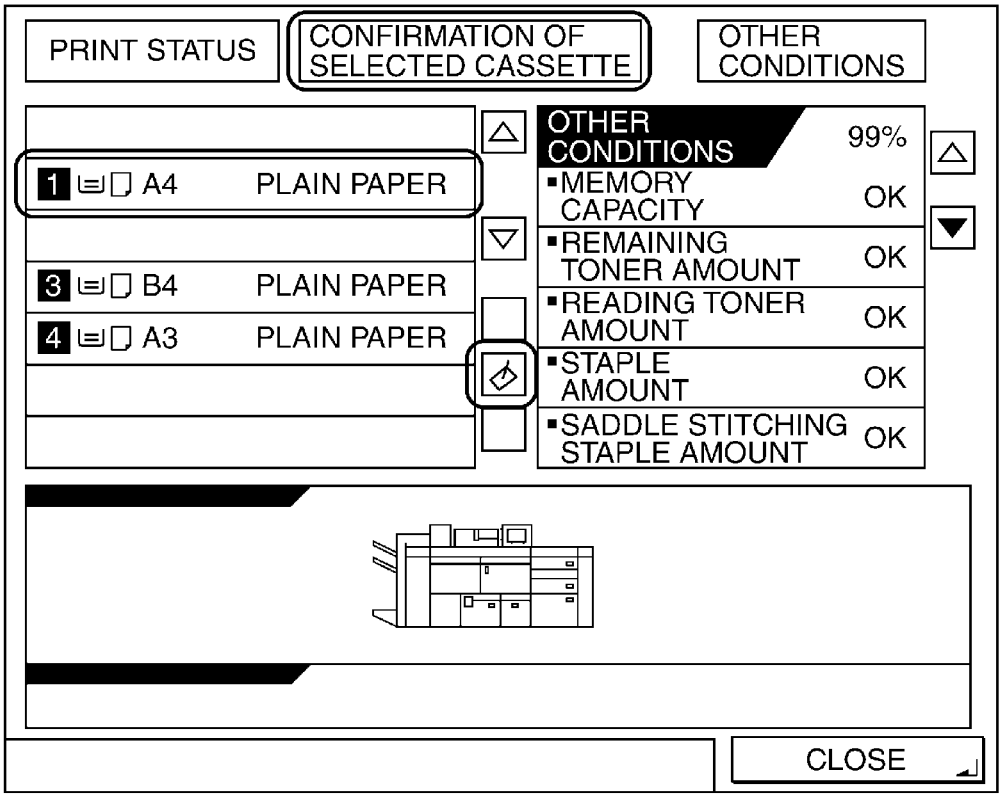
Figure 5B:
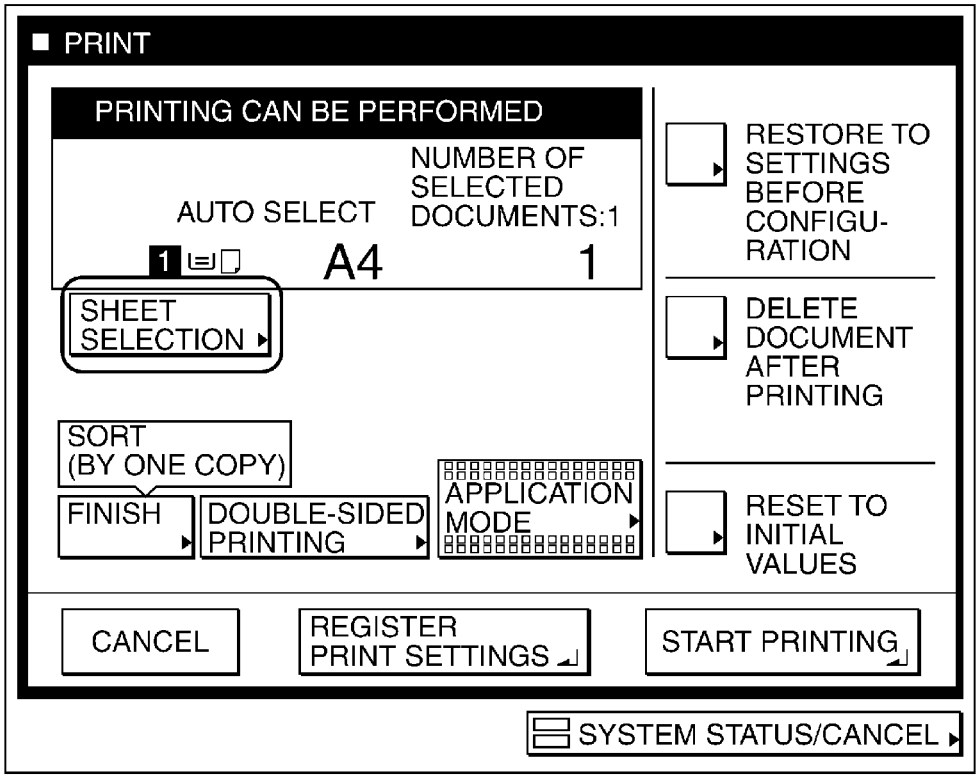
Figure 5C:
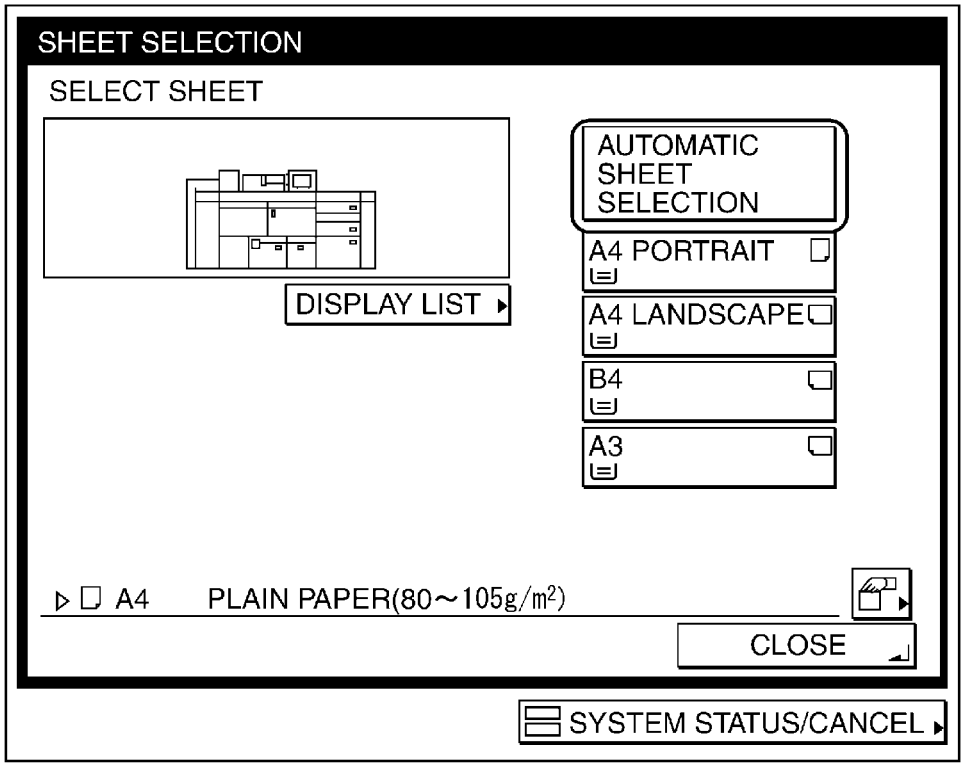
Figure 5D:
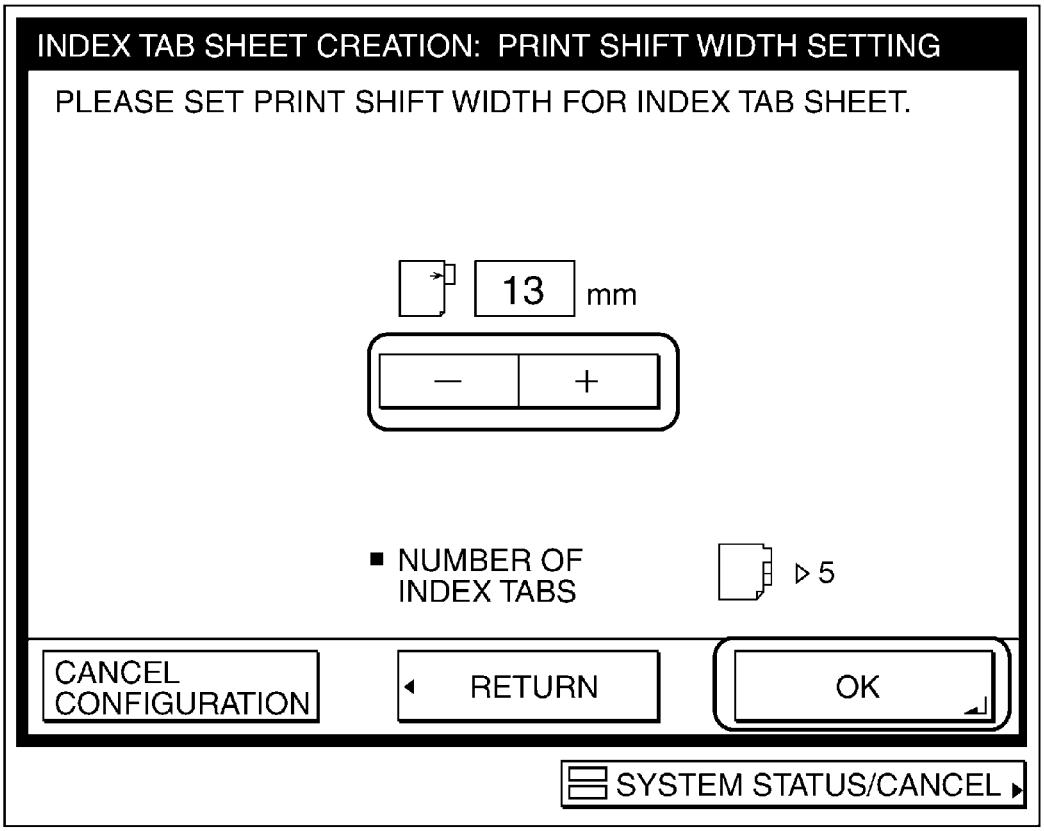
Figure 5E:
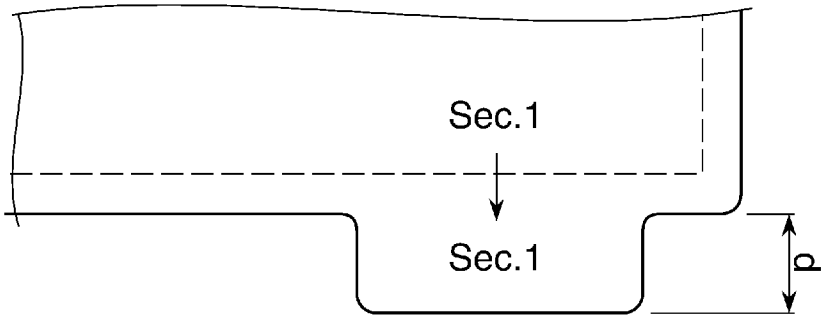

FIGS. 5A to 5E are views of a configuration screen displayed on the operation and display section 4 appearing in FIG. 1. FIG. 5A illustrates a display screen showing a type and size of a sheet registered in the sheet information-storing section 8 on a paragraph-by-paragraph basis, and a status of use, from which a sheet size can be selected and registered. FIG. 5B illustrates a print configuration screen for configuring print settings including sheet selection, before printing. Further, FIG. 5C illustrates a screen for selecting a sheet for use in printing, and FIG. 5D illustrates a screen for setting a print shift width for an index tab sheet in the case of index tab sheet printing. FIG. 5E illustrates a protruding dimension "d" (print shift amount) of an index tab.

On the FIG. 5A screen displayed on the operation and display section 4, when a sheet type on the sheet list and a sheet size are selected in association with a selected one of the plurality of sheet feed cassettes, the controller 3 registers the sheet type and the sheet size of the selected sheet feed cassette in the sheet information-storing section 8.

When executing print processing, the user selects a document (file) to be printed on a screen, not shown, displayed on the operation and display section 4. To perform printing using an index tab sheet, the user prepares a document including an image to be printed on the index tab. Next, the user selects a sheet feed cassette accommodating sheets for use in printing from the screen shown in FIG. 5C. At this time, the user sets a protruding dimension "d" (print shift amount) of the index tab as an index tab sheet printing option. At this time, the user designates the number of index tabs.

In addition, the user designates a page of the document, which is to be printed on an index tab sheet. If the document has a plurality of pages to be printed on index tab sheets, the plurality of pages are designated for printing on index tab sheets. Image data on the page(s) designated for index tab sheets is printed by shifting an image printing position according to the index shift amount set in advance. This enables an image to be printed on an index tab as well.

Figure 6:
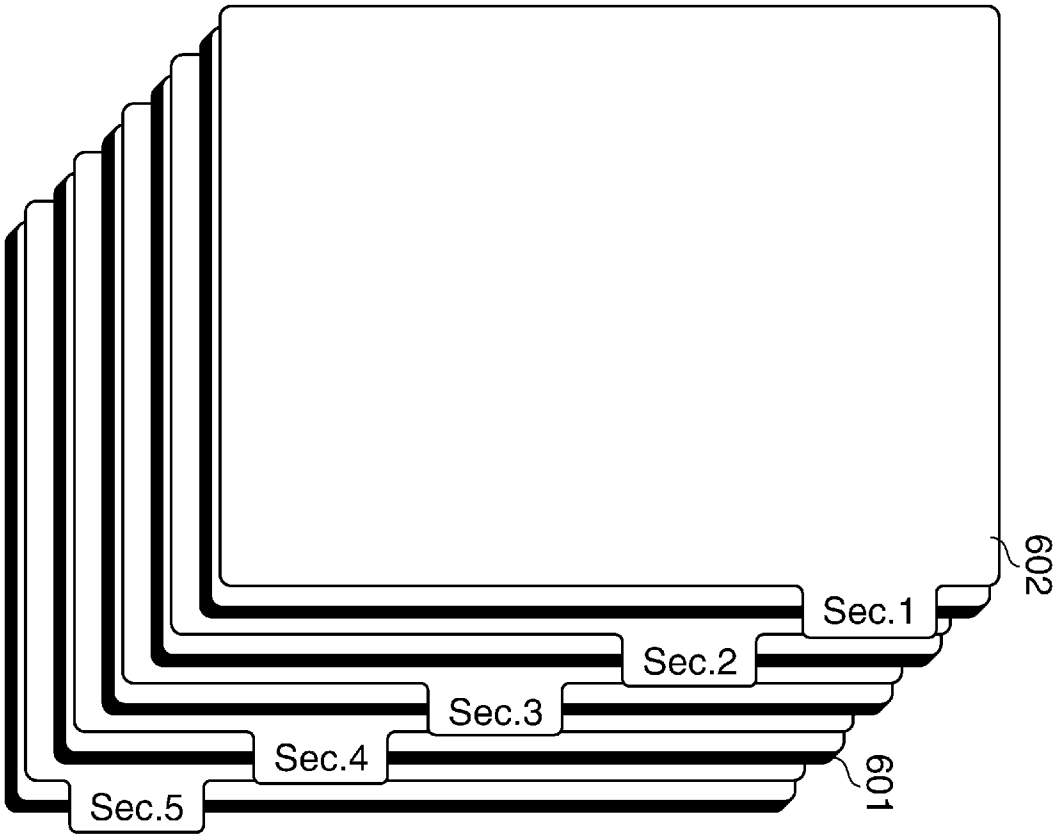
FIG. 6 is a view of an example of printed matter having index pages.

FIG. 6 is a view of an example of printed matter including pages printed on index tab sheets (hereinafter referred to as "index tab pages"). When printing is started, as shown in FIG. 6, a normal page without an index tab is printed on a normal sheet 601. The index tab page is printed by increasing an image forming area so as to enable an image of the index tab to be printed on an index tab sheet 602.

Sheet information on sheets configured as described above is stored in the sheet information-storing section 8 appearing in FIG. 1. Then, when printing is performed, the sheet information, i.e. the sheet list is used for setting image forming conditions suitable for a sheet or sheets to be used. Further, information on the index tab of the index tab sheet 602 (information indicative of a shape: protruding dimension) is used as a parameter for the skew correction operation, described hereinafter.

Figure 7A:
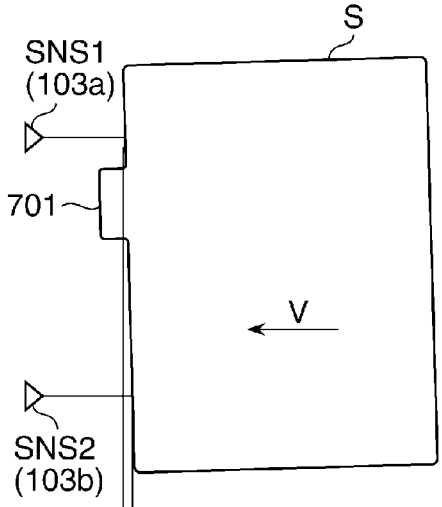
Figure 7C:
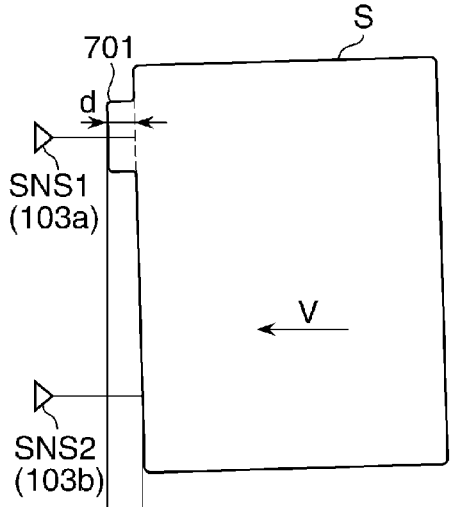
Figure 7B:
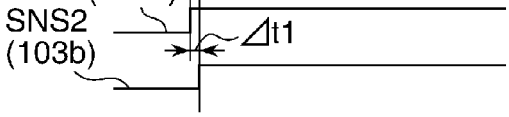
Figure 7D:
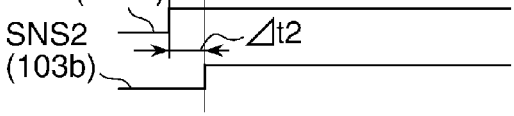
Figure 7E:
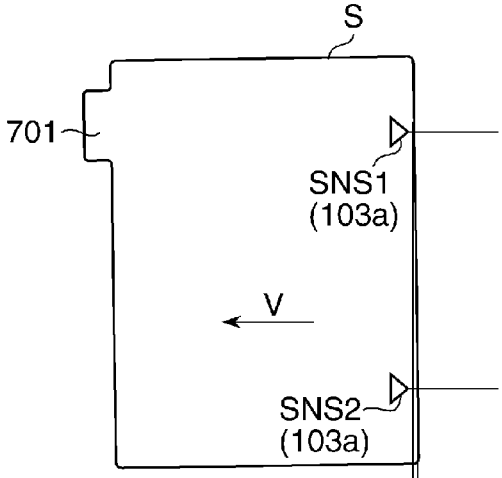
Figure 7F:
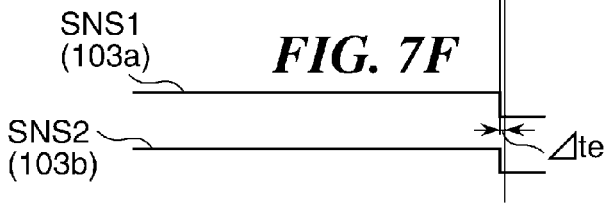

FIGS. 7A to 7F are views useful in explaining detection of skew of an index tab sheet performed by the skew correction unit 1 appearing in FIG. 1. As shown in the figures, an index tab 701 is a protruding portion which protrudes on a leading side of the sheet. FIG. 7A illustrates conveying of an index tab sheet having no index tab 701 formed at a location of the leading side of the index tab sheet where the sheet detection sensor 103*a* is passed, and FIG. 7B illustrates timing in which a leading edge of the index tab sheet shown in FIG. 7A is detected. FIG. 7C illustrates conveying of an index tab sheet having the index tab 701 formed at a portion of the leading side of the index tab sheet, where the sheet detection sensor 103*a* is passed, and FIG. 7D illustrates timing in which a leading edge of the index tab sheet shown in FIG. 7C is detected. FIG. 7E illustrates a state of the index tab sheet shown in FIG. 7C further conveyed from the state shown in FIG. 7C, and FIG. 7F illustrates timing in which a trailing edge of the index tab sheet shown in FIG. 7E is detected.

Firstly, it is assumed that the sheet conveying device conveys the index tab sheet S having the index tab 701 at the location shown in FIG. 7A. The index tab 701 of this sheet is formed at a location outside the range of detection by the sheet detection sensors 103*a* and 103*b*.

When the leading edge (leading side) of the index tab sheet S passes the sheet detection sensors 103*a* and 103*b*, the sheet detection sensors 103*a* and 103*b* detect the leading edge of the index tab sheet S, and send first and second sheet detection signals to the skew correction drive controller 1*a*, respectively. Now, it is assumed that the sheet detection sensor 103*a* outputs the first sheet detection signal (high (H) level signal in the illustrated example), and then after the lapse of a time period Δt1, the sheet detection sensor 103*b* outputs the second sheet detection signal (H level signal in the illustrated example). As shown in FIG. 7B, Δt1 indicates a time difference Δt between the respective detections, by the sheet detection sensors 103*a* and 103*b*, of the leading edge of the index tab sheet S with the index tab 701 at the location out of the range of detection by the sheet detection sensors 103*a* and 103*b*. In this case, the skew correction drive controller 1*a* controls the conveying speeds of the skew correction rollers 101*a* and 101*b* according to the time difference Δt1 to thereby correct the skew of the index tab sheet S, as described hereinafter.

Secondly, it is assumed that the sheet conveying device conveys the index tab sheet S having the index tab 701 formed at the location shown in FIG. 7C. The index tab 701 of this sheet is arranged at a location within the range of detection by the sheet detection sensor 103*a*.

It is assumed that the sheet detection sensor 103*a* outputs the first sheet detection signal, and then after the lapse of a time Δt2, the sheet detection sensor 103*b* outputs the second sheet detection signal. As shown in FIG. 7D, Δt2 indicates a time difference Δt between the respective detections, by the sheet detection sensors 103*a* and 103*b*, of the leading edge of the index tab sheet S with the index tab 701 at the location within the range of detection by the sheet detection sensor 103*a*. In this case, since the sheet detection sensor 103*a* detects the leading edge of the index tab 701, the time difference Δt2 is larger than the above-mentioned time difference Δt1 by a difference corresponding to the protruding dimension d.

In the case of a general rectangular standard sheet, for example, in the case of an A4-size sheet, the amount of skew of the sheet (sheet conveying speed V×detection time difference Δt) never becomes equal to 2 to 3 mm. On the other hand, in the case of an index tab sheet, the protruding dimension d of the index tab 701 generally has a length of ½ inch, i.e. approximately 12 mm.

Therefore, the skew correction drive controller 1*a* is configured such that when the time difference Δt is larger than a predetermined threshold value, it determines that the sheet detection sensor 103*a* has detected the index tab 701. The predetermined threshold value is determined by taking into account a normal skew amount of the standard sheet and the protruding dimension of the index tab 701. More specifically, assuming that an upper limit of the skew amount is approximately ±3 mm, and the protruding dimension of the index tab 701 is 12 mm, when both of the sheet detection sensors 103*a* and 103*b* detect a portion of the sheet other than the index tab, a value between −3 mm to 3 mm is obtained as the skew amount. On the other hand, when only one of the sheet detection sensors 103*a* and 103*b* detects the index tab, a value between 9 to 15 mm obtained by adding 12 mm of the protruding dimension of the index tab is detected as the skew amount. Here, the threshold value for determination is set to 6 mm as an intermediate value between 3 mm and 9 mm. Therefore, when the sheet does not skew, and at the same time only one of the sensors detects the index tab, the skew amount (sheet conveying speed V×detection time difference Δt) becomes equal to 12 mm. If the skew amount is a value between 12 to 15 mm, this means that a skew of the sheet S has occurred in which a side of the sheet S toward the sensor 103*a* is advanced, and whereas if the skew amount is a value between 9 to 12 mm, this means that a skew of the sheet S has occurred in which a side of the sheet S toward the sensor 103*b* is advanced.

By the way, there is a limit to the accuracy of correction by the skew correction rollers 101*a* and 101*b*. That is, when the skew amount is larger than a predetermined reference value, an error in the correction as well becomes so large that the correction is not always performed as intended. To overcome this problem, as shown in FIG. 7E, a trailing edge of the sheet (index tab sheet) is detected by the sheet detection sensors 103*a* and 103*b*. As shown in FIG. 7F, Δte indicates the time difference Δt between respective detections of the trailing edge of the index tab sheet S by the sheet detection sensors 103*a* and 103*b*.

Note that in the illustrated example, when the trailing edge of the index tab sheet S is detected, the sheet detection sensors 103*a* and 103*b* output the first and second sheet detection signals, which are low (L) level signals, respectively.

Then, the skew correction drive controller 1*a* controls the conveying speeds of the skew correction rollers 101*a* and 101*b* according to the time difference Δte to thereby correct the skew of the index tab sheet S. In this case, since the skew correction has been already performed according to the detection of the leading edge, the time difference Δte is very small, and hence if the skew correction drive controller 1*a* performs the skew correction according to the time difference Δte, the skew correction of the index tab sheet is completely performed.

Figure 8:
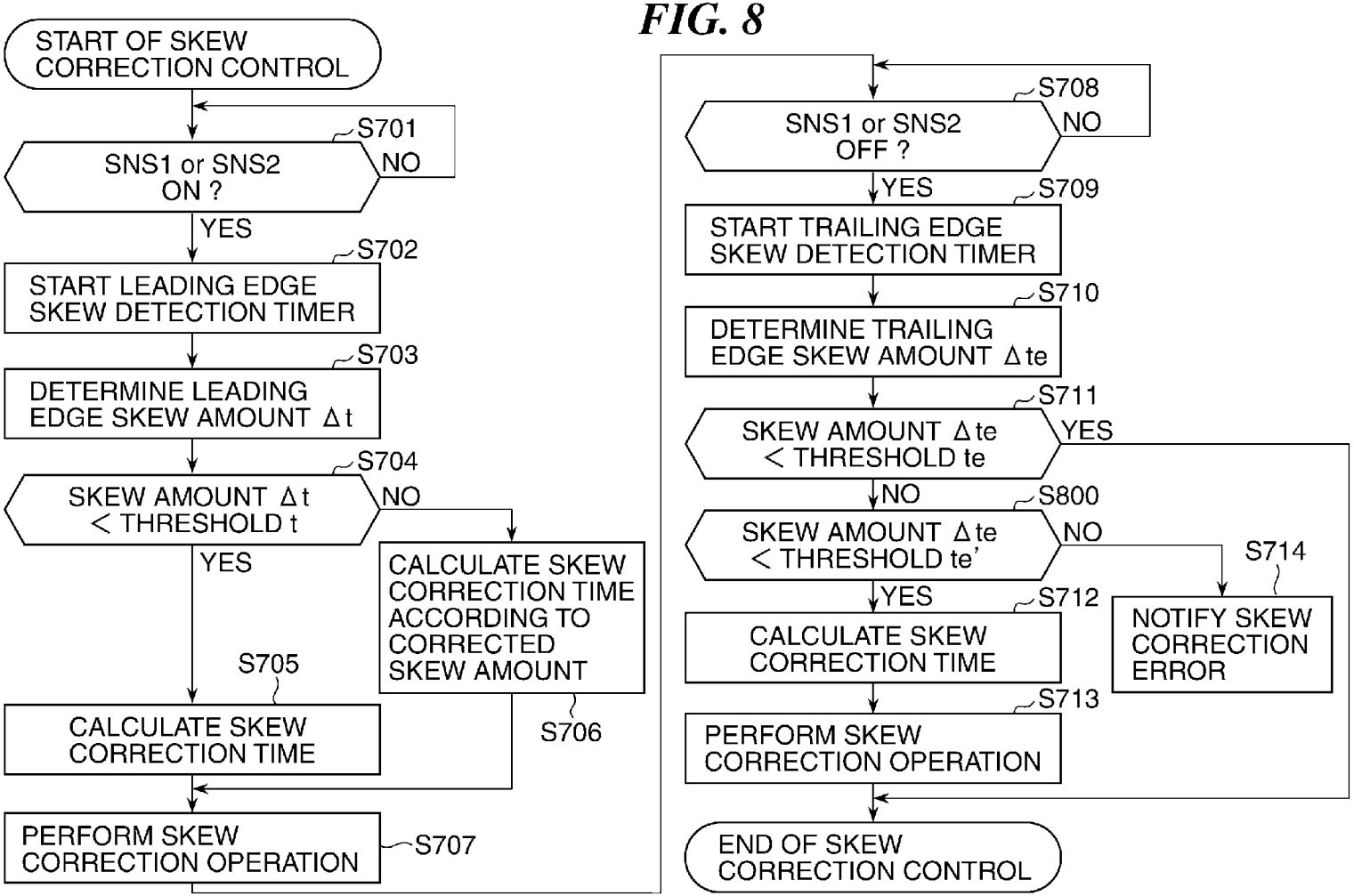
FIG. 8 is a flowchart of a skew correction control process for controlling skew detection and skew correction performed by the skew correction unit appearing in FIG. 1.

FIG. 8 is a flowchart of a skew correction control process for controlling skew detection and skew correction performed by the skew correction unit 1 appearing in FIG. 1. The skew correction control process in FIG. 8 is executed by the skew correction drive controller 1*a*.

When the user performs the operation for starting printing from the operation and display section 4, the controller 3 controls the engine controller 2 to perform the printing as described above. In doing this, a sheet is conveyed from the sheet feed cassette as mentioned above, and the controller 3 also starts the sheet skew correction control.

Before starting the skew correction control, the controller 3 reads the settings of the sheet characteristics including a type, a shape, etc. of the sheet selected by the user from the sheet information-storing section 8, and sends the same to the engine controller 2. Then, the engine controller 2 provides the settings of the sheet characteristics to the skew correction drive controller 1*a* together with a skew correction control start signal. Here, it is assumed that an index tab sheet is selected as a sheet, and the index tab sheet is set as the feature in the settings of the sheet characteristics.

Upon receipt of the skew correction control start signal, the skew correction drive controller 1*a* monitors whether or not one of the sheet detection sensors 103*a* (SNS1) and 103*b* (SNS2) detects a leading edge of the sheet (S701). That is, the skew correction drive controller 1*a* monitors whether or not either of the sheet detection sensors 103*a* and 103*b* is turned on. If neither of the sheet detection sensors 103*a* and 103*b* detects the leading edge of the sheet (NO to the step S701), the skew correction drive controller 1*a* enters a standby state.

If one of the sheet detection sensors 103*a* and 103*b* detects the leading edge of the sheet (YES to the step S701), the skew correction drive controller 1*a* starts up a skew detection timer 1*aa* incorporated therein in order to detect an amount of skew (S702). When the other of the sheet detection sensors 103*a* and 103*b* detects the leading edge of the sheet, the skew correction drive controller 1*a* stops time measurement by the skew detection timer 1*aa*. The skew correction drive controller 1*a* determines a time period measured by the skew detection timer 1*aa* as the detection time difference (leading edge detection time) Δt which represents the skew amount (leading edge skew amount) (S703).

Then, the skew correction drive controller 1*a* determines whether or not the leading edge skew amount is smaller than a first skew threshold value t set in advance (S704). If the skew amount is smaller than the first skew threshold value t (YES to the step S704), the skew correction drive controller 1*a* calculates the correction time ts, described with reference to FIG. 3B, by the following equation (1) (S705). As mentioned above, the leading edge skew amount is represented by the detection time difference (leading edge detection time) Δt.

$$ts=a\cdot V0\cdot\Delta t/(V0-Vs)+b \quad (1)$$

wherein V0 represents a normal sheet conveying speed in the skew correction unit 1, Vs represents a sheet conveying speed during the skew correction operation in the skew correction unit 1, "a" represents a correction value for adjusting a slip amount and the like of the skew correction roller 101*b*, and "b" represents an offset value for adjusting a mounting position error between the conveying rollers and the sensors and the like.

On the other hand, if the skew amount is not smaller than the first skew threshold value t (NO to the step S704), the skew correction drive controller 1*a* determines that one of the sheet detection sensors 103*a* and 103*b* has detected the index tab 701, and calculates the correction time ts, described with reference to FIG. 3B, according to a corrected skew amount obtained by reducing the skew amount by an amount corresponding to the index protruding dimension "d" by the following equation (2) (S706):

$$ts=a\cdot(V0\cdot\Delta t-d)/(V0-Vs)+b \quad (2)$$

wherein d represents the protruding dimension of the index tab 701. That is, the correction time ts (correction amount) is reduced by a·d/(V0−Vs).

After the correction time ts is thus calculated, the skew correction drive controller 1*a* performs the sheet skew correction by driving the skew correction roller on a side of the sheet advanced due to the skew, at the speed Vs reduced from the speed V0, during the correction time ts (S707).

Next, the skew correction drive controller 1*a* monitors whether or not either of the sheet detection sensors 103*a* (SNS1) and 103*b* (SNS2) is turned off (OFF) in order to detect the trailing edge of the index tab sheet S (S708). If neither of the sheet detection sensors 103*a* and 103*b* is turned off (OFF) (NO to the step S708), the skew correction drive controller 1*a* enters a standby state.

On the other hand, if one of the sheet detection sensors 103*a* and 103*b* is turned off (YES to the step S708), the skew correction drive controller 1*a* starts up a trailing edge detection timer lab incorporated therein (S709). If the other of the sheet detection sensors 103*a* and 103*b* is turned off, the skew correction drive controller 1*a* stops time measurement by the trailing edge detection timer lab.

The skew correction drive controller 1*a* determines a time period measured by the trailing edge detection timer lab as the detection time difference (trailing edge detection time) Δte which represents a trailing edge skew amount (S710). That is, the trailing edge skew amount is represented by the trailing edge detection time Δte.

Next, the skew correction drive controller 1*a* determines whether or not the trailing edge skew amount is smaller than a second skew threshold value te set in advance (S711). This second skew threshold value te is smaller than the first skew threshold value t. If the trailing edge skew amount Δte is smaller than the second skew threshold value te (YES to the step S711), the skew correction drive controller 1*a* terminates the skew correction control, and sends a notification to this effect to the engine controller 2.

On the other hand, if the trailing edge skew amount is not smaller than the second skew threshold value te (NO to the step S711), the skew correction drive controller 1*a* determines whether or not the trailing edge skew amount Δte is smaller than a third skew threshold value te' which is larger than the second skew threshold value te (S800). If the trailing edge skew amount Δte is smaller than the third skew threshold value te', the skew correction drive controller 1*a* calculates the correction time ts according to the trailing edge skew amount Δte, as described above (S712). More specifically, the skew correction drive controller 1*a* calculates the correction time ts by an equation transformed from the equation (1) by substituting Δte for Δt. Then, the skew correction drive controller 1*a* performs the sheet skew correction by driving the skew correction roller 101*a* or 101*b*, at the speed Vs reduced from the speed V0, during the correction time ts (S713), followed by terminating the present process.

On the other hand, if the trailing edge skew amount Δte is not smaller than the third skew threshold value te', the skew correction drive controller 1*a* notifies a skew correction error (S714) to the engine controller 2. Then, the engine controller 2 sends the notification to the controller 3, and the controller 3 causes a message saying that the trailing edge skew amount exceeds the acceptable range to be displayed on the operation and display section 4 as an alarm (skew correction error).

At this time, when the print start operation has been performed at the client PC 14-1 or 14-2, the controller 3 notifies the client PC 14-1 or 14-2 of the alarm.

If the alarm is displayed as described above, the user can know that the printed matter contains a sheet for which the skew correction has not been correctly performed. Further, the skew correction control may be configured such that when the trailing edge skew amount Δte exceeds the acceptable range, the user can select interruption of the print operation.

Figure 9:
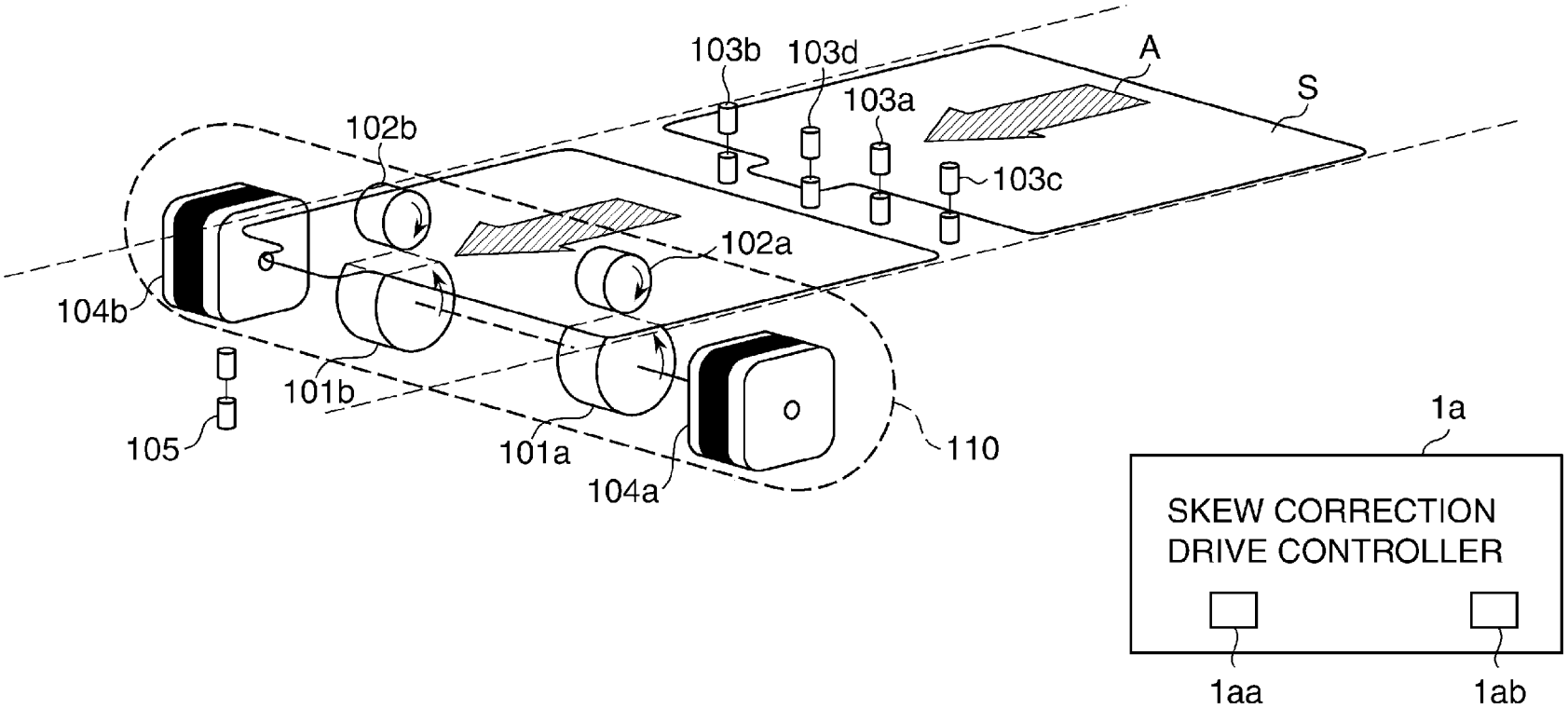
FIG. 9 is a perspective view of a variation of the skew correction unit including a third detection sensor and a fourth detection sensor for detecting a trailing edge of a sheet, and a skew correction drive controller.
Figure 10:
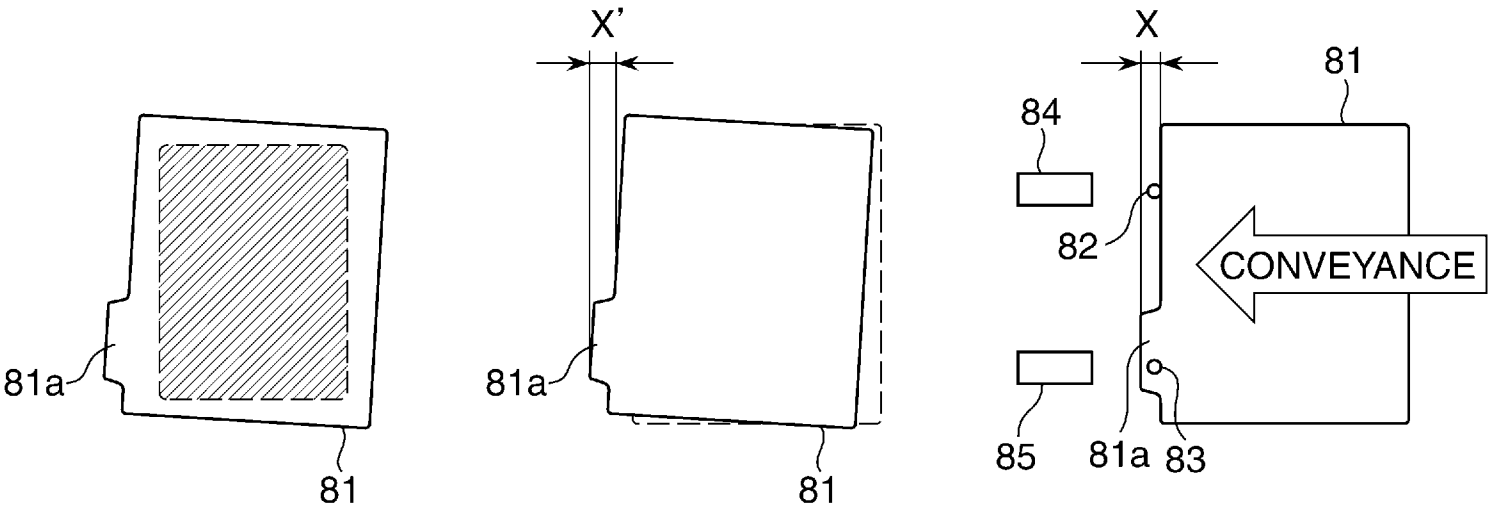
FIG. 10 RELATED ART
FIG. 10 is a view useful in explaining a conventional skew correction mechanism.

FIG. 9 is a perspective view of a variation of the skew correction unit 1 and the skew correction drive controller 1*a*. As shown in the variation, the skew correction unit 1 may be configured such that sheet detection sensors (third and fourth detection sensors 103*c* and 103*d*) are disposed separately from the sheet detection sensors 103*a* and 103*b*, and the sheet detection sensors 103*c* and 103*d* detect the trailing edge of the sheet.

Furthermore, if a plurality of the skew correction mechanisms (skew correction rollers, and so forth) are provided to perform the skew correction, a degree of freedom in the arrangement of the skew correction unit and surrounding components is increased, whereby it is possible to cope with higher conveying speed and perform the skew correction with a higher accuracy.

As described above, according to the present embodiment, it is possible to correct skew of a sheet, such as an index tab sheet, during conveyance thereof, with a simple arrangement without setting detailed information, such as a position and a width of the index tab sheet, on a sheet-by-sheet basis.

Although in the above-described embodiment, the description has been given of the image forming apparatus including the sheet conveying device, the above-described sheet conveying device may be used in an image reading apparatus. That is, the image reading apparatus may be configured to include the above-described sheet conveying device, a document tray on which an original, which is a sheet, is set, and a scanner (scanner unit) which obtains image data by reading an image of the sheet conveyed from the document tray to a document reading position by the sheet conveying device.

Further, as is clear from the above description, in FIG. 1, the skew correction drive controller 1*a* functions as a skew amount calculation unit, a correction unit, a speed changing unit, and a notification unit.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

For example, the functions described in the above embodiment may be executed by a CPU, or the like. That is, a method of controlling execution of the functions described in the above embodiment may be caused to be executed by the CPU. Further, a control program implementing the method may be executed by the CPU. The control program is stored e.g. in a computer-readable storage medium.

Aspects of the present invention can also be realized by a computer of a system or apparatus (or devices such as a CPU or MPU) that reads out and executes a program recorded on a memory device to perform the functions of the above-described embodiment, and by a method, the steps of which are performed by a computer of a system or apparatus by, for example, reading out and executing a program recorded on a memory device to perform the functions of the above-described embodiment. For this purpose, the program is provided to the computer for example via a network or from a recording medium of various types serving as the memory device (e.g., computer-readable medium).

This application claims the benefit of Japanese Patent Application No. 2010-266973, filed Nov. 30, 2010, which is hereby incorporated by reference herein in its entirety.

What is claimed is:

1. A sheet conveying device comprising:

first and second detection sensors that are disposed in a direction crosswise to a conveying direction for conveying an index tab sheet having an index tab, for detecting the index tab sheet;

an acquiring unit configured to acquire a size of the index tab;

first and second conveying units that are disposed in a direction crosswise to the conveying direction, for conveying the index tab sheet;

a timer configured to measure a leading edge detection time from when one of the first or second detection sensor detects a leading edge of the index tab sheet to thereby output a first signal to when the other of the first or second detection sensor detects the leading edge of the index tab sheet to thereby output a second signal; and a skew correction unit configured to control respective conveying speeds of the first and second conveying units independently of each other so that a skew corresponding to the leading edge detection time is corrected, wherein, in a case where the index tab sheet is conveyed, when the leading edge detection time measured by the timer is not smaller than a predetermined threshold value since one of the first or second detection sensor detects the index tab of the index tab sheet, the skew correction unit determines a skew correction amount based on the measured leading edge detection time and size of the index tab acquired by the acquiring unit, and wherein when the leading edge detection time measured by the timer is smaller than the predetermined threshold value since both the first and second detection sensors do not detect the index tab, the skew correction unit determines the skew correction amount based on the measured leading edge detection time, regardless of the size of the index tab.

2. The sheet conveying device according to claim 1, wherein the index tab is a protruding portion of the index tab sheet, which protrudes in the conveying direction.

3. The sheet conveying device according to claim 1, wherein:

the first and second detection sensors are disposed at respective locations upstream of the first and second conveying units in the conveying direction, the timer further measures a trailing edge detection time from when one of the first or second detection sensor detects a trailing edge of the index tab sheet to when the other of the first or second detection sensor detects the trailing edge of the index tab sheet, and the skew correction unit further controls the conveying speeds of the first and second conveying units so that a skew corresponding to the trailing edge detection time is corrected.

4. A sheet conveying device comprising:

first and second detection sensors that are disposed in a direction crosswise to a conveying direction for conveying an index tab sheet having an index tab, for detecting the index tab sheet, the first and second detection sensors being disposed at respective locations upstream of the first and second conveying units in the conveying direction;

first and second conveying units that are disposed in a direction crosswise to the conveying direction, for conveying the index tab sheet;

a timer configured to measure:

a leading edge detection time from when one of the first or second detection sensor detects a leading edge of the index tab sheet to thereby output a first signal to when the other of the first or second detection sensor detects the leading edge of the index tab sheet to thereby output a second signal; and a trailing edge detection time from when one of the first or second detection sensor detects a trailing edge of the index tab sheet to when the other of the first or second detection sensor detects the trailing edge of the index tab sheet; and a skew correction unit configured to control:

respective conveying speeds of the first and second conveying units independently of each other so that a skew corresponding to the leading edge detection time is corrected; and the conveying speeds of the first and second conveying units so that a skew corresponding to the trailing edge detection time is corrected, wherein when the time measured by the timer is not smaller than a first threshold value since one of the first or second detection sensor detects the index tab of the index tab sheet, the skew correction unit reduces a skew correction amount by a predetermined amount for correcting the skew corresponding to the leading edge detection time measured based on the first and second signals output from the first and second detection sensors, and wherein when the trailing edge detection time is not smaller than a second threshold value and is smaller than a third threshold value, the skew correction unit corrects the skew corresponding to the trailing edge detection time.

5. The sheet conveying device according to claim 4, including a notification unit configured to notify a skew correction error when the trailing edge detection time is not smaller than the third threshold value.

6. The sheet conveying device according to claim 1, further including an image reading unit configured to read an image on the sheet of which the skew has been corrected by the skew correction unit.

7. The sheet conveying device according to claim 1, further including an image forming unit configured to form an image on the sheet of which the skew has been corrected by the skew correction unit.

8. The sheet conveying device according to claim 1, wherein the acquiring unit comprises:

an input unit for manually inputting the size of the index tab; and a storage unit for storing the size input by the input unit.

* * * * *